United States Patent [19]

Scheck, Sr.

[11] 4,108,451

[45] Aug. 22, 1978

[54] ROLLER SKATES WITH HAND BRAKES

[76] Inventor: Wilson Scheck, Sr., 2900 SW. 27th St., Gainesville, Fla. 32608

[21] Appl. No.: 797,479

[22] Filed: May 16, 1977

Related U.S. Application Data

[63] Continuation-in-part of Ser. No. 604,606, Aug. 14, 1975, abandoned, which is a continuation-in-part of Ser. No. 478,939, Jun. 13, 1974, abandoned.

[51] Int. Cl.[2] ..... A63C 17/14; A63C 17/08

[52] U.S. Cl. ..... 280/11.2; 280/11.24; 280/11.36

[58] Field of Search ..... 280/11.24, 11.36, 11.2, 280/11.21, 11.19

[56] References Cited

U.S. PATENT DOCUMENTS

| | | | |
|---|---|---|---|
| 1,188,335 | 6/1916 | Shoemaker | 280/11.36 R X |
| 3,010,732 | 11/1961 | Correll | 280/11.24 |

FOREIGN PATENT DOCUMENTS

| | | | |
|---|---|---|---|
| 15,148 of | 1896 | United Kingdom | 280/11.2 |

*Primary Examiner*—Joseph F. Peters, Jr.
*Assistant Examiner*—Milton L. Smith

[57] ABSTRACT

A pair of common roller skates are modified by replacing the normal metal casters with inflated or solid rubber tires which have braking means attached to the wheels on each of the roller skates. The shoe is attached as an integral part of the skate and balancing rods are provided to the rear portion of the skates. A control belt is worn around the waist of a person desiring to use the skates. The belt has various safety devices attached thereto and further has a bicycle brake lever with a hand grip which has attached thereto a brake cable connecting the brake lever to each of the brake drums on the skates. With this device a person using the skates can cause deceleration and eventual stopping of the skates.

1 Claim, 4 Drawing Figures

ROLLER SKATES WITH HAND BRAKES

CROSS REFERENCES TO RELATED APPLICATIONS

This application is a continuation-in-part application of application Ser. No. 604,606, now abandoned, for "Roller Skates with Hand Brakes" filed in the U.S. Pat. Office on August 14, 1975, which itself was a continuation-in-part application of application Ser. No. 478,939, now abondoned, for "Scheck Wheels" filed in the U.S. Patent Office on June 13, 1974.

BACKGROUND OF THE INVENTION

1. Field of the Invention

This invention relates to a human transportation vehicle and more particularly to a pair of common roller skates modified to have braking means controlled by hand operation of the person wearing the skates.

2. Description of Prior Art

Roller skates in various forms have been used by children as a means of transportation and recreation for many years. Recently, many adults as well as children have been riding devices known as skate boards for recreational purposes. There is a need to provide a safe and economical means of transportation or recreation and this can be done by making sufficient changes to the normal type of roller skate devices.

SUMMARY OF THE INVENTION

It is therefore an object of this invention to improve devices commonly known as roller skates to provide a safe and economical means of transportation and recreation.

It is also an object of this invention to provide roller skates which will allow a user to be transported over rough terrain and at greater speeds than is presently possible with roller skates employing standard metal casters.

It is still a further object of this invention to provide an integrated frame and shoe for the wheel which prevents a tendency for motion between the shoe platform and the foot and which is designed to give proper balancing in relation to the wheels such that the wearer does not have to worry about ankle collapse.

It is yet still a further object of this invention to provide balancing rods attached to the skates as a safety factor when the person is in a stationary position.

Another object of this invention is to allow the roller skates to be decelerated and eventually stopped by braking means which are controlled by hand operation of the wearer of the skates.

These objects and others are carried out by the particular roller skates having hand controlled brakes as shown and described herein.

Specifically, the roller skates will use large inflated or soft solid tires instead of the usual small metal casters. The frame of the skates and shoe are permanently attached in such a way that motion between the shoe platform and the foot is eliminated so that the user has only to balance the wheel to the ground without worrying about ankle collapse. A brake disc wheel is attached to each skate. The user of the roller skate device wears a leather safety and control belt around his waist, the safety and control belt having a hand control lever which is connected by cable to each of the roller skates. When this brake lever is depressed by the user, a disc caliper brake, attached to the end of the brake cable, engages the disc wheel and the friction between the two causes the skates to decelerate and eventually stop. The caliper brake includes rubber or steel tips. The belt worn around the user can also contain various safety devies such as rear view mirrors, reflectors and turn signals.

DESCRIPTION OF THE PREFERRED EMBODIMENT

While I have illustrated the preferred embodiment of my invention as embodied in skates having one wheel, it is to be understood that I contemplate the application of the principles of this invention to a skate having more than one wheel.

Figure 1:
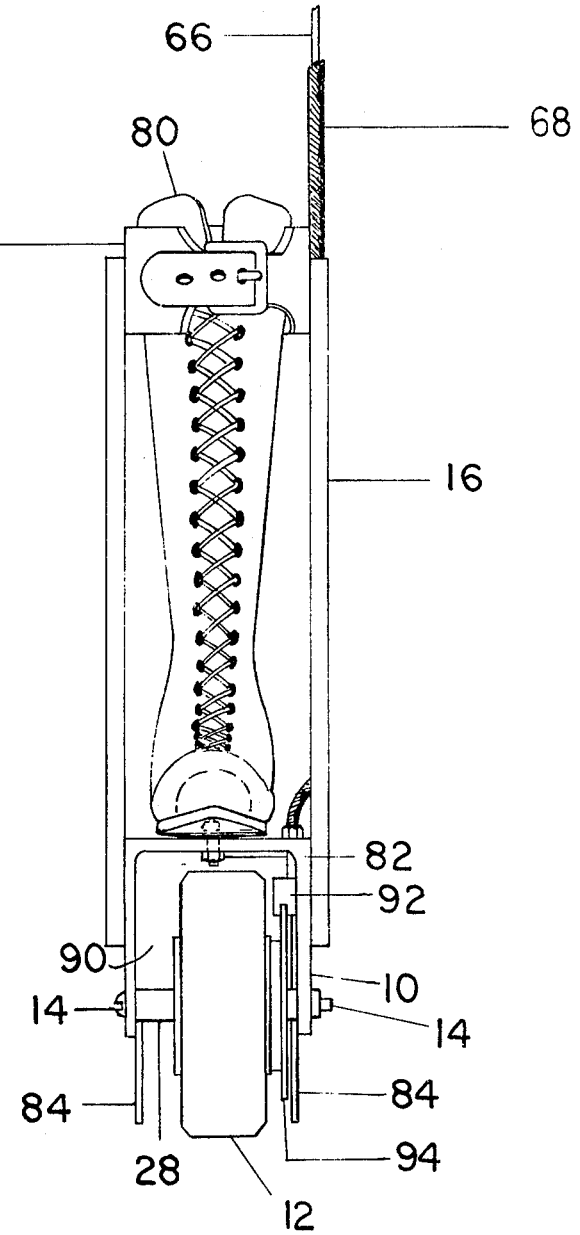
FIG. 1 is a front view of the preferred embodiment of one of the skates of this invention.
Figure 2:
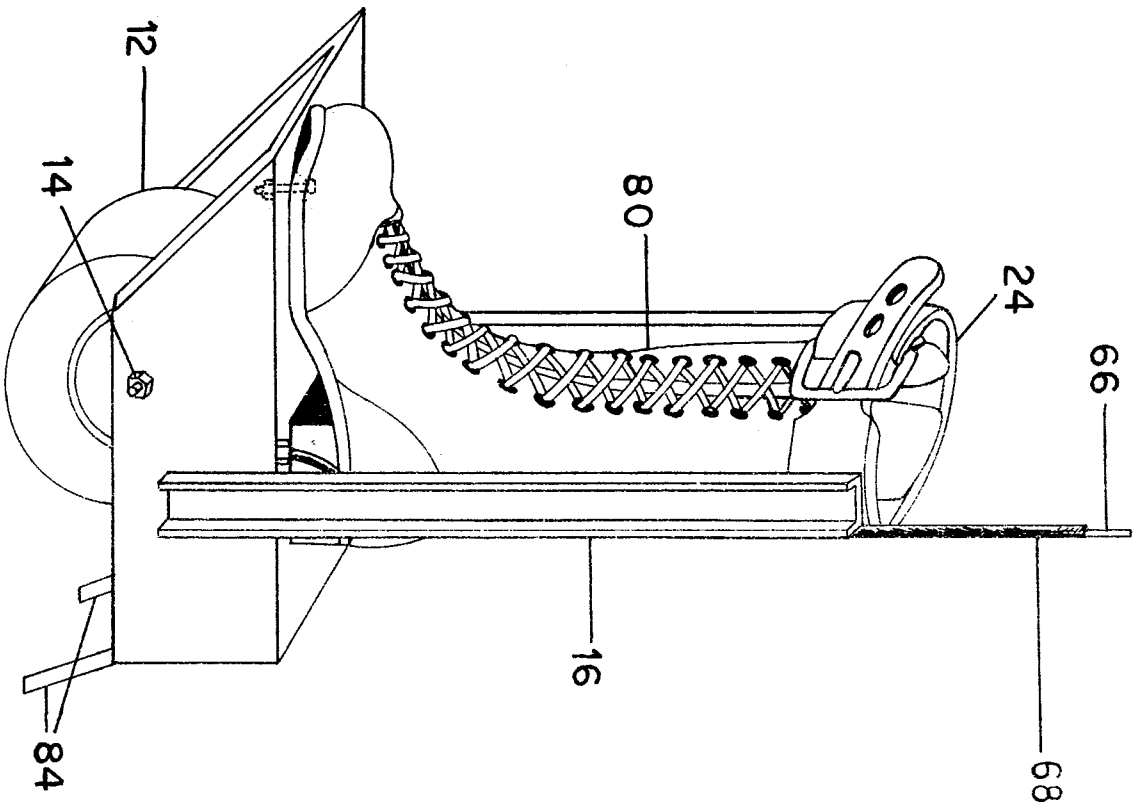
FIG. 2 is a three quarter side view of the skate shown in FIG. 1.
Figure 3:
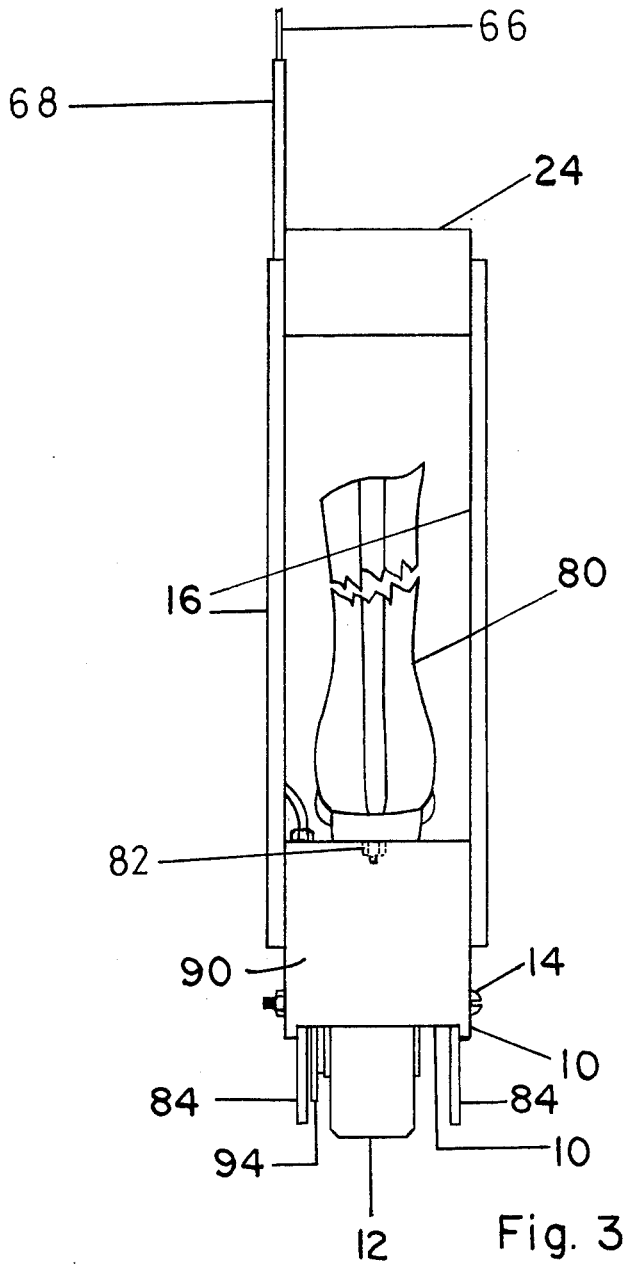
FIG. 3 is a rear view of the preferred embodiment of one of the skates of this invention.

Referring to the preferred embodiment of this invention with the skates being shown in FIGS. 1, 2, and 3 the basic frame 10 is constructed of metal. The dimensions may, of course, vary but a typical configuration is a top platform consisting of an area 4 inches by 12 inches square (this area will vary depending on the foot size of the user). The sides of the frame would have a height of six inches.

A wheel 12 is attached to the frame by an ordinary carriage bolt 14. Bolt 14 will pass through holes drilled in the frame, the number of holes, of course, varying with the number of wheels employed, one bolt being required for each wheel. Various spacers 28 will be used to center the wheels on the carriage bolts between the sides of the frame. The spacers may consist of any type tubing which will fit concentrically over the carriage bolt. The wheel 12 may vary but it generally should be a semi-pneumatic rubber tire industrial wheel.

Ankle support irons 16 have their bottom two inches welded to wheel frame 10 and provide an ankle support for the skate. The attachment of the ankle support irons to the frame has for its purpose the provision of support to the ankles, with the result that the foot and leg act as one point of balance between the wheel and the ground, as opposed to two points of balance if there were no sturdy support for the leg. The ankle support irons vary in width and height depending on the wearer's size.

A shoe 80 is permanently affixed to the top of frame 10 by one or more flat headed bolts 82 which attach the bottom of the shoe to the frame. In the preferred embodiment the shoe would be bolted to the frame in both the front and rear of the shoe. The shoe is further secured and attached to the leg of the user by leg strap 24.

Balancing rods 84 are braced with a square piece of light metal 90 that fits within the back part of the wheel channel and which is tilted to make the balancing rods 84 extend slightly behind the wheel frame. The bracing metal also serves as a mud and water stop. The brace and balancing rods 84 are welded to the wheel frame.

Figure 4:
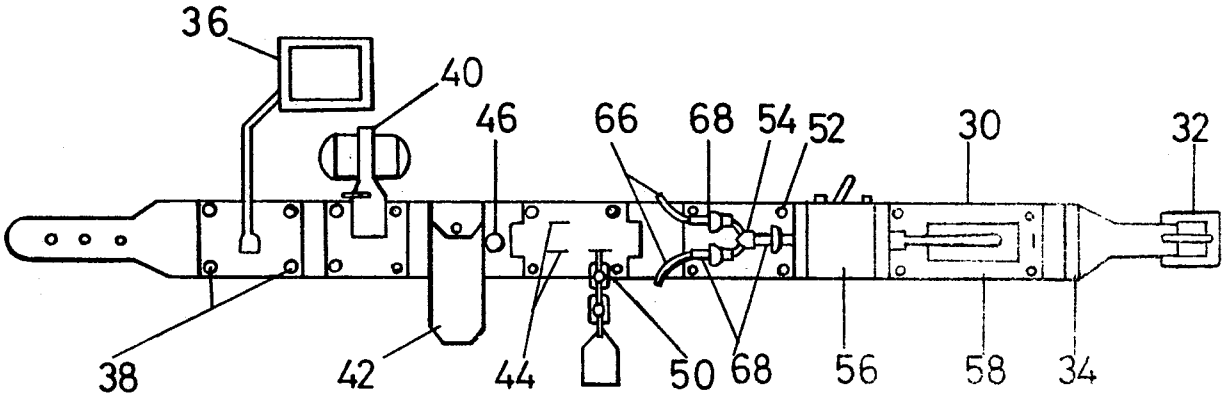
FIG. 4 shows the belt worn by the user of the skates which contains the brake control means and various safety devices.

The type of skate that has heretofore been described in detail is designed to reach speeds of 35 or 40 miles per hour. With these types of skates, it is obviously important to be able to slow down and stop the skates in a safe and convenient manner. To this end a braking means is provided which can be hand operated and which is in easy access to the normal reach of the person wearing the skates. There is provided a leather belt 30 which is worn around the waist of the user of the skates which has a belt buckle 32 with a belt loop 34. The leather belt is provided with various areas to hold various safety devices and most importantly to hold the hand controlled braking means. As can be seen in FIG. 4, the preferred embodiment of the hand controlled braking means consists of a base plate 52 bolted to the leather belt 30 with a three cable holder and adjuster bolts to put two cables together with the aid of cable lock bolt 54. The brake is operated by a standard bicycle brake lever 58 having a normal finger grip, said brake lever being welded to a base plate which is attached to the belt. Braking cables 66 extend from bicycle brake lever 58 down to each of the skates and are covered by outer casing 68.

As can best be seen in FIGS. 1 and 2, the casing 68 with the enclosed cable 66 runs through a hole in the top portion of the skate frame 10 and cable 66 has attached to its end a disc caliper brake 92, preferably with steel or rubber tips, which engages disc wheel 94, which is itself welded to one side of the wheel rim. Upon squeezing the hand brake lever, disc brake 92 frictionally engages disc wheel 94 causing the wheel to slow down and eventually stop.

Both sides of the wheel contain standard type of commercially available bearing and clutch combinations to prevent the wheel from rolling backward.

Various wheel spacers 28 made from thin walled conduit pipe can be provided around the carriage bolts as needed.

Not only does the belt support the brake controls but it also provides a means of holding safety devices. A head lamp 40 is bolted via a bracket to a base plate which is bolted to the belt. A generator tail light is bolted to the lower side of the bracket to provide directional signaling. A tail light 46 works in conjunction and at the same time with the headlamp and is operated by batteries stored in case 42. A tailer hitch 44 with welded angle irons on either end is attached to the belt by a base plate, the left angle iron holding tail light 46 bolted to it and the right angle iron having a reflector bolted to it. Trailer hitch 44 is secured to the belt by bolts 50. Steel bracket 56 holds the light and directional switches along with the right directional unit. Because of the speeds at which these skates are operated, the described safety devices are very important and can not be considered accessories.

While only the preferred embodiment of this invention has been shown, the skates can be modified to allow for two wheels. The ankle support irons 16 would be attached to frame 10 to allow the ankle support irons to pivot about a rivet attaching the ankle support irons to the frame. This is required when there are two wheels to give a bending of the knee or a natural leg motion without losing the ankle support. This pivoting action between the ankle support iron and the frame of the skate is not needed in the one-wheel skate because the user can pivot on the carriage bolt and single wheel. This is obviously not possible in a two-wheeled skate.

The use of the skate is simple. The foot is placed into the permanently attached shoe and leg strap 24 is buckled. The wearer can then balance himself on the skates with the help of the balancing rods in a relatively simple fashion. Moving is achieved by placing one foot in front of the other, leaning forward with the body and forcing the leg downward and rearward while the other leg is lifted and placed forward. By repeating this motion, the wearer may move much as a user of ordinary roller skates. However, he will be able to go much faster because of the large diameter wheels and also be able to traverse rough terrain also because of the larger wheels. With this greater speed, it is very important that the wearer use the associated safety and braking belt. Because of the permanent attachment of the shoe to the wheel frame, and the securing strap, there is a feeling of the wheel and frame being part of the leg.

Having described only typical preferred forms of the invention and a few alternatives, I do not wish to be limited or restricted to specific details herein set forth, but wish to reserve to myself any modifications or variations that may appear to those skilled in the art.

What is claimed is:

1. An improved roller skate in combination with a control belt worn around the user of the skates comprising;

a frame having a top surface and two side surfaces extending perpendicularly down from said top surface, a carriage bolt extending through a hole in each of said extending surfaces of said frame, a wheel concentric to said carriage bolt in between said two extending surfaces, a shoe fixedly attached to the top of said frame, an ankle support iron fixedly attached to each of said extending surfaces of said frame, said irons extending perpendicular to and above said top surface of said frame, a disc wheel welded to one side of a rim of said wheel, said control belt fitting around the waist of the user, and braking means fixedly secured to said belt further consisting of:

a brake grip designed to be moved by hand operation, a first cable secured to said brake grip, second cables secured to said first cable, one running to each of of the skates to be worn, a disc brake connected to the other end of said cable positioned to engage said disc wheel, whereby upon the brake grip being squeezed by hand, the cables will move upward causing the disc brake to frictionally engage said disc wheel to decelerate and stop said skate.

* * * * *